US008209772B2

(12) United States Patent
Curry

(10) Patent No.: US 8,209,772 B2
(45) Date of Patent: Jul. 3, 2012

(54) TEACHER'S STRATEGIES TOOLS APRONS

(76) Inventor: Mildred L. Curry, Linden, NJ (US)

( * ) Notice: Subject to any disclaimer, the term of this patent is extended or adjusted under 35 U.S.C. 154(b) by 86 days.

(21) Appl. No.: 12/573,206

(22) Filed: Oct. 5, 2009

(65) Prior Publication Data

US 2010/0083416 A1 Apr. 8, 2010

Related U.S. Application Data

(60) Provisional application No. 61/195,113, filed on Oct. 4, 2008.

(51) Int. Cl.
*A41B 13/10* (2006.01)

(52) U.S. Cl. ..... 2/48; 2/247; 2/250; 434/395

(58) Field of Classification Search ..... 2/48, 49.1, 2/49.2, 49.3, 49.4, 50, 51, 52, 244, 245, 247, 2/429, 250, 251; 434/395, 429; D2/861, D2/772, 862, 863, 864
See application file for complete search history.

(56) References Cited

U.S. PATENT DOCUMENTS 1,055,151 A * 3/1913 Emerson ..... 273/272
1,135,833 A * 4/1915 Morse ..... 2/48
1,979,879 A * 11/1934 Harris ..... 2/48
2,171,676 A * 9/1939 Wallace ..... 2/48
D133,954 S * 9/1942 Siegle ..... D2/864
2,364,258 A * 12/1944 Wallace ..... 2/92
2,378,380 A * 6/1945 Brown ..... 2/50
2,416,609 A * 2/1947 Brehm ..... 2/50
2,538,677 A * 1/1951 Ferrand ..... 2/48
2,607,040 A * 8/1952 Zaleski ..... 2/51
2,617,103 A * 11/1952 Westgarth ..... 2/48
2,846,685 A * 8/1958 Ehrich ..... 2/51
2,870,447 A * 1/1959 Pitcock ..... 2/51
3,371,829 A * 3/1968 Phillips ..... 224/230
3,428,962 A * 2/1969 Slimovitz ..... 2/48
3,624,686 A 11/1971 Beals
3,724,101 A * 4/1973 Slezak ..... 434/170
4,037,272 A * 7/1977 Shani ..... 2/48
4,063,369 A * 12/1977 Hart ..... 434/156
4,168,544 A * 9/1979 Kallman ..... 2/94
4,253,197 A * 3/1981 Posta ..... 2/69
4,378,214 A * 3/1983 Scherer ..... 434/81

(Continued)

OTHER PUBLICATIONS

Ubscure Article Directory, http://www.ubscure.com/Art/122681/140/A-Brief-History-of-Aprons.html, pp. 1-2.*

(Continued)

*Primary Examiner* — Khoa Huynh
*Assistant Examiner* — Brieanna Fuller
(74) *Attorney, Agent, or Firm* — Porzio, Bromberg & Newman, P.C.

(57) ABSTRACT

The teacher's strategies tool apron of the present invention provides easy access and organization to the tools needed to enhance any instructional segment and promote student retention in PreK to 8th grade. The "tools of the trade" are located in the appropriately matched pockets of the apron, paired with researched best practices education strategies. Together they maximize the attention and involvement of the learning audience while simultaneously giving easy access and organization to the tools themselves to the presenter. The pockets have a signifying visual cue logo identifying the purpose of the tool that goes into that pocket and create a memory map for the presenter. When worn by the presenter the aprons bring the focus of the presentation's participants to its wearer.

3 Claims, 2 Drawing Sheets

U.S. PATENT DOCUMENTS

| | | | | | |
|---|---|---|---|---|---|
| 4,536,975 | A | * | 8/1985 | Harrell | 36/136 |
| 4,636,172 | A | * | 1/1987 | Fredericks | 434/159 |
| 4,637,075 | A | * | 1/1987 | Ingrisano et al. | 2/94 |
| 4,710,979 | A | | 12/1987 | Bull et al. | |
| 4,722,464 | A | * | 2/1988 | Wright | 224/602 |
| 4,723,323 | A | * | 2/1988 | Wright, Jr. | 2/48 |
| 4,825,471 | A | * | 5/1989 | Jennings | 2/94 |
| 4,949,843 | A | | 8/1990 | Stokes | |
| 4,975,061 | A | * | 12/1990 | Avrill | 434/304 |
| D317,375 | S | * | 6/1991 | Severinsen | D2/725 |
| 5,173,968 | A | * | 12/1992 | Fox | 2/244 |
| 5,210,881 | A | * | 5/1993 | Stocker et al. | 2/247 |
| 5,353,975 | A | * | 10/1994 | Libertucci | 224/681 |
| 5,398,345 | A | * | 3/1995 | Kenneth et al. | 2/247 |
| 5,468,152 | A | | 11/1995 | Lenart | |
| D381,190 | S | * | 7/1997 | Deon | D2/863 |
| 5,742,940 | A | * | 4/1998 | Sparks | 2/79 |
| 6,151,715 | A | * | 11/2000 | Doherty | 2/48 |
| 6,216,931 | B1 | | 4/2001 | Trawinski | |
| D457,195 | S | * | 5/2002 | Thadani | D21/398 |
| 6,397,390 | B1 | * | 6/2002 | Henderson et al. | 2/69 |
| 6,473,905 | B1 | | 11/2002 | Katz | |
| 6,694,520 | B2 | * | 2/2004 | Smith | 2/48 |
| 7,013,493 | B2 | * | 3/2006 | Briscoe et al. | 2/247 |
| D522,719 | S | * | 6/2006 | Sanders | D2/864 |
| 7,404,242 | B1 | * | 7/2008 | Perler | 24/712.2 |
| 2001/0046661 | A1 | * | 11/2001 | Shorter | 434/395 |
| 2005/0246823 | A1 | * | 11/2005 | Groom | 2/247 |

OTHER PUBLICATIONS

Custom Pulpit Robes, Evangelical Cassock, http://www.victoriousrobes.com/custom15.html.*

Gaspard, Inc.—Handcrafted vestments and paraments since 1954, http://store.gaspardinc.com/items_cassocks.html.*

* cited by examiner

TEACHER'S STRATEGIES TOOLS APRONS

CROSS REFERENCE TO RELATED APPLICATION

This application claims the benefit of U.S. Provisional Patent Application No. 61/195,113, filed Oct. 4, 2008, the entirety of which is hereby incorporated by reference into this application.

BACKGROUND OF THE INVENTION

1. Field of the Invention

The present invention relates to a teacher's strategies tools apron that enhances instructional delivery and augments student performance.

2. Description of the Related Art

Aprons for use as teaching aids are known. U.S. Pat. No. 3,624,686 describes an apronlike article having removable pockets. The pockets are of various colors for the teaching of color recognition.

U.S. Pat. No. 4,710,979 describes a mother's bib with detachable multicolored two dimensional infant toys to aid supervised baby play.

U.S. Pat. No. 5,468,152 describes educational children's clothing. The article of clothing is a garment having a plurality of pockets. Each of the pockets displays at least one member of an educational concept and contains a removable object displaying the educational concept. Each of the removable objects is secured to one of the pockets to prevent disassociation of the objects from the garment.

It is desirable to provide a teacher's strategies tools apron including pockets having symbols on the pockets for receiving corresponding instructional tools related to instructional curriculum which tools can be used during an instructional presentation.

SUMMARY OF THE INVENTION

The teacher's strategies tool apron of the present invention provides easy access and organization to the tools needed to enhance any instructional segment and promote student retention in PreK to 8th grade. The "tools of the trade" are located in the appropriately matched pockets of the apron, paired with researched best practices education strategies. Together they maximize the attention and involvement of the learning audience while simultaneously giving easy access and organization to the tools themselves to the presenter. The pockets have a signifying visual cue logo identifying the purpose of the tool that goes into that pocket and create a memory map for the presenter. When worn by the presenter the aprons bring the focus of the presentation's participants to its wearer. During that time, the attention, participation, and involvement of the audience increases when the apron is worn and its tools employed. Through the increased attention and involvement of the participants, more of the presentation will be remembered and internalized, and the presenter's tools for stimulating their involvement will be arranged efficiently and within arm's reach in the pockets of the wearer's apron as he/she moves about the room.

The teacher's apron of the present invention includes two embodiments. In a first embodiment, a full version or chef-type apron includes a plurality of pockets for the tools used in an instructional presentation. A loop formed of a hook and loop material above the pocket provides a place for an attachment to the teacher's tool as a loss prevention measure and the pocket below the teacher's tool as a storage place. A window pocket can be provided. It is preferred that this embodiment has eleven pockets. In a second embodiment, a half version or contracted-type of the apron includes a plurality of pockets for the tools used in an instructional presentation. It is preferred that this embodiment has six pockets.

The teaching strategies tools apron of the present invention has pockets that hold eleven or six tools representing the best practices in education for increasing learner's attention and retention. Each pocket has a visual cue logo that symbolizes a tool to be used with its strategy. The aprons' strategies, tools, and visual cue logos reflect cross-curricular applications. A novel approach to providing easy access to tools of the trade anywhere the wearer goes in an instructional setting. Allows the hands-free transportation of a presenter's tools eliminating the use of a cart. Pockets' construction allows hands easy entry and exit for object retrieval. While in use, the full and half version add protection to the wearer's clothes. The teacher's strategies tools apron is designed for multi-tasking and is washable, durable, and wearable. One size fits most and is non-gender specific. The teacher's strategies tools apron is usable across grade levels PreK-8th.

The invention will be more fully described by reference to the following drawings.

DETAILED DESCRIPTION

Figure 1:
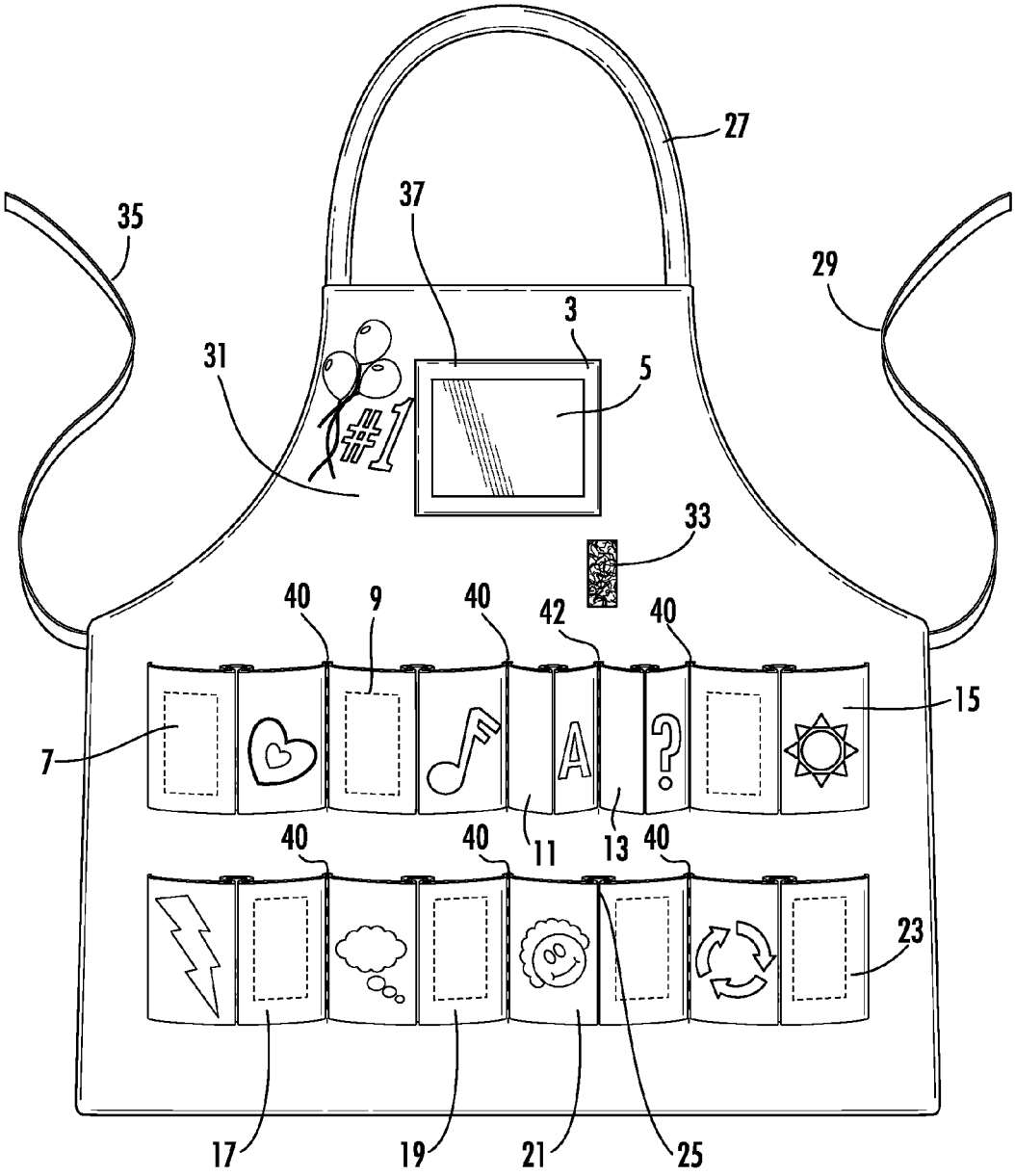
FIG. 1 is the front view of the full version chef type teacher's strategies tools apron with the eleven pockets and their signifying logos.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of a full version of teacher's strategies tools apron in accordance with the teachings of the present invention. The full version of the apron is, similar to a conventional chef apron that is worn in a kitchen at a restaurant. Neck strap 27 slips over the head of a wearer. Two straps 29 and 35 tie behind the waist of the wearer to secure it to the user.

There are three rows of a plurality of pockets in this embodiment of the full version. The first row has two pockets 3 and 5. The second row has five pockets 7, 9, 11, 13 and 15, and the third row has four pockets 17, 19, 21 and 23.

The bib part of the apron 31 that rests on the chest just below the collar bone of the wearer has the first row, two pockets 3 and 5 centered, and both placed congruent to one another. Pocket 3 is a window pocket and has a square opening that holds a photo, for example having a size of 4"×4", that can be slid in from the top. Pocket 5 behind pocket 3 is larger, for example by 2", than window pocket 3 opening. Indicia such as a number (#1) logo is positioned to the left of pocket 3 and a grouping of indicia of three brightly colored balloons is positioned to the left of the first logo (#1) displayed on 31. An alternating camera logo 37 can appear on the upper left corner border of pocket 3, the frame of the window pocket 3, and can replace the (#1) logo on apron bib 31.

The second row of pockets is formed of one length of material divided by vertical stitching 40 into four equal size pockets. A third pocket is divided in half by vertical stitching 42 to form pockets 11 and 13. All the pockets have a ⅜" fold 25 in their center that allows more room for a hand to reach in for an object's retrieval. Going from left to right, pocket 7 has a logo of a heart inside a heart on the lower right side of the pocket's fold. Pocket 9 is the same size and has a sixteenth note music logo on the right side of the fold. Pocket 11 has an "A" logo on the right side of the pocket's fold and just above that pocket there is a Velcro loop 33 to which a ribbon, for example having a length of about 10-12", can be attached and then attached to the "A" tool which can be put inside pocket 11 so it is not misplaced after its use during a presentation. Pocket 13 has a question mark logo on the right side of the fold. Pocket 15 in this row is the same size as pocket 7 and 9. A "sun" logo is on the lower right side of the fold on pocket 15.

The third row of the apron has four pockets constructed from one length of material and vertically stitched by vertical stitching 40 into four equal size pockets. These pockets all have a fold 25 down the middle of each of them. Pocket 17 has a "lightning bolt" logo on the left side of the fold 25. Pocket 19 has a "thought balloon" with three trailing circles descending in size as they move down and to the right away from the "thought balloon" yet a part of it. Pocket 21 has a "smiley face" kid with a colorful bonnet on its head. This logo is on the upper right side of fold 25 on pocket 21. Pocket 23 has a "three arrowhead shapes with trailing ends forming a circle" logo, pointing clockwise on the left side of the fold 25 in the center of that side of pocket 23.

Eleven pockets each are a place for a "tool of the trade" with a strategy to pair with it, identified by a relational logo. These together form the invention of the full version of the teacher's strategies tools apron chef-type.

Figure 2:
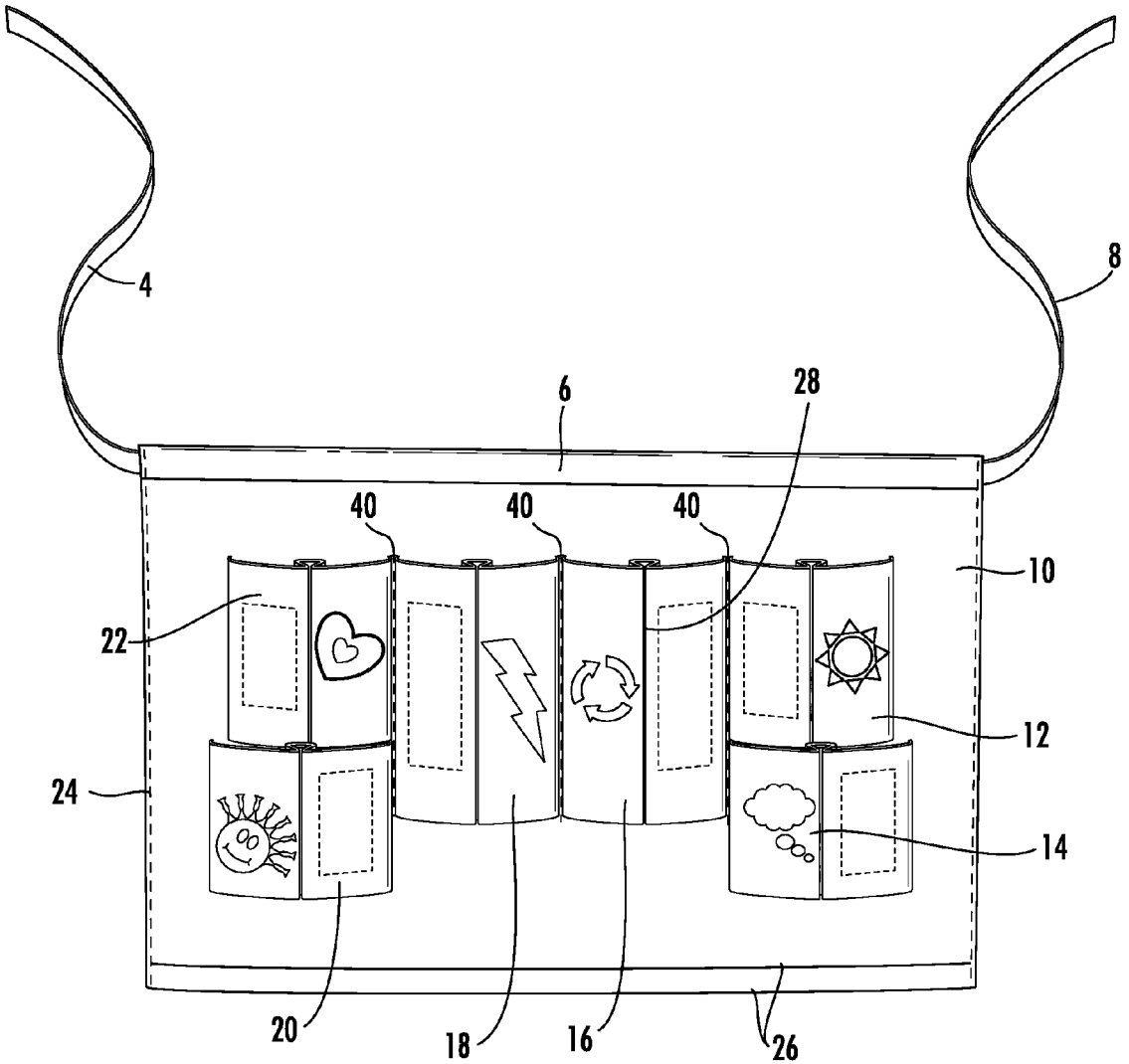
FIG. 2 is the front view of the half version contracted type teacher's strategies tools apron with six pockets and their signifying logos.

The half version of the teacher's strategies tools apron is shown in FIG. 2. Two waist ties 4 and 8 attached to the waistband 6. Waist ties 4 and 8 and waistband 6 are attached to the half version apron base 10. The apron base 10 is double border reinforcement stitched 26 at its bottom and single border reinforcement stitched 24 on both its sides.

Apron base 10 includes a plurality of pockets for example six pockets, 12, 14, 16, 18, 20 and 22. Two of the pockets 20 and 14 are positioned lower than the others, are on the outside and overlap two upper outside pockets 22 and 12. This arrangement creates a larger-pocket 22 and 12 inside-a-smaller-pocket 20 and 14 look.

The first four pockets 12, 16, 18 and 22 are just below waistband 6. These four pockets are made from a single piece of material, divided equally by vertical stitching 40. Each pocket has a centerfold 28. The second set of pockets is individual pockets 20 and 14 positioned as explained above.

Pockets 12, 14, 16, 18, 20 and 22 all have identified logos that represent their purpose/tool/strategy. From left to right pocket 22 has a heart in a heart logo to the lower right side of fold 28. Pocket 20 is below and overlaps pocket 22 at its bottom half with a "smiley face" kid with standing dreadlocks logo to the lower left of fold 28. Pocket 18 is to the right of pockets 20 and 22 with a "lightning bolt" logo to the right half of its fold 28. Pocket 16 is to the right of pocket 18 with "three arrow head shapes with trailing ends forming a circle" logo in the center of the left half of this pocket to the left side of fold 28. Pocket 12 is to the right of pocket 16 with a "sun" logo to the right side of fold 28 at its center. Pocket 14 is below pocket 12 and overlaps its bottom half with a "thought balloon" logo to the left of fold 28 and centered to that side of pocket 14.

Six pockets form the basis of the half version or contracted type of the strategies tools apron and the description of its construction with the visual cue logos completes it.

The two versions of the instructional aprons organize, transport, and create a memory map for the presenter to employ multiple educational strategies and the tools that go with them. In a teaching/learning environment the manipulation of the appropriate tools and the employment of their paired strategies will augment the participation and involvement of an audience so more of the presentation will be remembered via the teacher's strategies tools aprons.

Within the teaching learning environment, infinite opportunities exist for a better presentation yet because the tool may be out of sight, out of reach, or out of mind, it may be completely out of the question for the teacher to interrupt that teachable moment to look for it. The choice to include or enhance some instructional concept with a more colorful or graphic approach may be sacrificed because it can't be located at the time it is most needed. So some students' clarity on that concept may also be lost due to the non-inclusion of the very tools for which these learners' cognitive learning style calls. The aprons worn by a teacher or leader make readily available those tools that by instructional design enhance teaching presentations creating a more effective and efficient delivery of information as well as support the learning audience's cognitive styles.

The components of the aprons have been selected because each creates a dramatic shift in the learning environment when used in an instructional segment. The research supporting the strategies derived from best practices and how they work with the aprons are under a separate cover of Copyright as "The Teacher's Apron Pocket Tool Tips". A second description of the pockets' use and logos and a brief explanation of their connection to researched teaching strategies have been included in this application.

In the full version apron, the first row comprise two pockets; the window pocket on a pocket. Window pocket 3 can show a picture celebrating and recognizing the Student of the Week, and pocket 5 behind pocket 3 can hold a removable quick flash camera to capture moments of exciting learning episodes for a class journal or bulletin board.

The next row has five pockets. From left to right pocket 7 with the hearts will hold removable "arks" acts of random kindness chips and reward stickers. These catch students being good and let them know it's valued and appreciated. The accumulated chips can be exchanged for extra privileges or treasure items. Pocket 9 with the music note is the place for a removable musical CD or tape for setting class tone, climate or transitioning. Pocket 11 is the "A" pocket for a removable signal alarm to get students' attention with an attached ribbon hooked into a Velcro loop 33 for easy location. This saves a teacher's voice and establishes an alert approach to getting students' attention. Pocket 13 is a teacher's choice pocket and bears a question mark for a removable instructional tool. Choice is a chance for creativity and should be afforded to everyone in a learning environment. Pocket 15 displays a sun and holds removable colored markers or colored chalk used to clarify for students or an audience, black, white, gray or fuzzy skills, concepts, and ideas by highlighting them in color.

Pocket 17 has a lightning bolt and is for holding a removable electronic device such as a digital timer, a laser pointer or a mouse used in a teaching session to bring in technology more often. These are purposeful for attracting learners' attention as well. Pocket 19 shows a thought balloon for post-its used by the teacher for holding removable quick idea notes, private reminders and help to students, and also holds removable news worthy current event articles. Pocket 21 has a smiley face kid and hides a removable fun time item; i.e., toy squiggly or cuddly as a temporary surprise treat for an unsuspecting correct responder to a question. The temporary treat can be used three or four times in one presentation for different responders. Pocket 23 has three arrow heads with trailing ends forming a circle on it pointing in a clockwise direction. Pocket 23 represents your turn and holds all removable students' name sticks to be randomly chosen without looking by the teacher to respond to a question. This grants all students equal access to respond in the learning environment, insures more attentive listening and fair opportunity during the lesson segment.

In FIG. 2, pocket 12 can hold a similar removable item as pocket 15 described above. Pocket 14 can hold a similar removable item as pocket 19. Pocket 16 can hold a similar removable item as pocket 23. Pocket 18 can hold a similar removable item as pocket 17. Pocket 20 can hold a similar removable item as pocket 21

The organization and easy access of these teaching tools along with the memory map of the visual cue logos on the pockets of the aprons save teachers' steps, frustration, time, and teachable moments. And the inclusion of instructional strategies, based in best practices in Education, during a teaching episode increases students' interest, participation, and involvement in the learning so they can remember more of it. These are often the very elements that can make or break lessons for students. The teacher's strategies tools apron maximizes these advantages in an educational setting, enhancing the instructional delivery and augmenting student performance. The reasons teachers teach.

It will be appreciated that the present invention includes any variation in the number of pockets or the arrangement of the visual cue logos or choice of visual cue logos still constitutes a strategies tools apron if it is organizing, transporting, and creates easy access to two and three dimensional tools of a particular trade for training or instructing an audience in a field or industry.

It will be appreciated that the present invention includes any variation in the garment that is positioned over external clothing and has the same use as the strategies tools aprons is relational and represents an alternative to the teaching aprons, i.e. vest, jacket, pinafore. The present invention provides a pallet of pockets specifically arranged and visually ID'd to create organization for tools paired with their instructional strategies.

The present invention insure presenter's easy access to the tools of an industry or professional field while he/she is in motion in a teaching learning environment.

The present invention creates a memory map for the wearer of the apron via visual cue logos on the pockets matched to best practices in that industry.

The present invention as the following features: promotes the participation and involvement of an audience during an instructional segment with the employment of the tools and strategies while wearing the apron; augments and improves student retention and performance in a lesson; Pairs strategies and tools that are cross-curricular-ant not subject or theme-specific and targets grades Pre-Kindergarten to eighth with adaptable application at secondary level and adult.

The present invention has adaptability of the aprons' tools, strategies, and logos for any instructional presentation at the secondary level, grades 9-12$^{th}$, college and adult is a variation of the products use and scope.

DRAWINGS—REFERENCE NUMERALS

FIG. 1. Full Version and Front View of the Teacher's Strategies Tools Apron

3—window pocket
5—pocket behind window pocket
7—heart in a heart pocket
9—sixteenth-note music pocket
11—"A" pocket
13—question mark pocket
15—sun pocket
17—lightning bolt pocket
21—"smiley face" kid pocket
23—three arrowhead shapes with trailing ends forming a circle pocket
25—⅜" center pocket fold
27—neck strap
29—waist tie R
31—upper apron bib
33—Velcro loop
35—waist tie L
37—camera logo
40—vertical stitching
42—vertical stitching FIG. 2. Half Version (hv) Front View of the Teacher's Strategies Tools Apron

8—waist tie hv R
6—waistband hv
4—waist tie hv L
10—apron base hv
12—sun pocket hv
14—thought balloon pocket hv
16—three arrowhead shapes with trailing ends forming a circle pocket hv
18—lightning bolt pocket hv
20—"smiley face" kid pocket hv
22—heart in a heart pocket hv
24—border reinforcement stitching hv
26—double border reinforcement stitching hv
28—⅜" pocket fold hv It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A strategies tools apron to be worn by educators and trainers in their industry comprising:

a neck strap extending from a top portion of the apron, a two curved upper portions each respectively on each side of the apron, the said two curved upper portions extend down from the top portion of the apron to a middle portion of the apron in which the top portion has a smaller width than the middle portion, a tie on either side of said apron positioned at the middle portion adapted for securing the apron to a body of a person, the middle portion defined by two side portions extending to a bottom portion of the apron;

a plurality of pockets arranged in a first, second and third row on said apron, the first row of pockets are positioned below the top portion between the two curved upper portions, the said first row of pockets includes a first said pocket having a window with a square opening, said first pocket being adapted for receiving a photograph, and a second said pocket behind said first pocket, said second pocket being adapted to receive a camera;

each of said pockets in the second and third row are arranged in a predetermined arrangement and having an associated visual cue identification logo and an associated removable tool, the second row of pockets are positioned below the first row of pockets within the middle portion between said two side portions, the said second row of pockets includes a third said pocket having said associated visual cue identification logo of one or more hearts and said associated removable tool is an award of behavior, a fourth said pocket having said associated visual cue identification logo of a musical note and said associated removable tool is a musical object, a fifth said pocket having said associated visual cue identification logo of a letter A and said associated removable tool is an alarm signal, a sixth said pocket having said associated visual cue identification logo of a question mark and said associated removable tool is a tool selected by a teacher, and a seventh said pocket having said associated visual cue identification logo of a sun and said associated removable tool is one or more colored writing implements, the third row of pockets are positioned below the second row of pockets within the middle portion between the two side portions above said bottom portion, the said third row of pockets includes an eighth said pocket having said associated visual cue identification logo of a lightning bolt and said associated removable tool is an electronic device, a ninth said pocket having a said associated visual cue identification logo of a thought balloon and said associated removable tool is a written article and post it notes, a tenth said pocket having said associated visual cue identification logo of a smiley face and said associated removable tool is a toy or treat and an eleventh said pocket having said associated visual cue identification logo of a circle of three arrow heads forming a circle and said associated removable tool is student name sticks, said pockets in the second and third rows forming a memory map via the associated visual cue identification logos matched to the predetermined arrangement of said pockets, and each of said pockets in said second and third rows are formed by vertical stitching of material to said apron;

wherein said each of said associated removable tools is used with instructional strategies.

2. The apron of claim 1 wherein each of said pockets includes a fold.

3. A strategies tools apron to be worn by educators and trainers in their industry comprising:

a waistband and a tie on either side of the waistband for securing the apron to a waist of a person, two side portions extending down from said waistband to a bottom portion of said apron, a plurality of pockets arranged in a first and second row on said apron, the first row of pockets are positioned below said waistband, said first row of pockets includes a first said pocket having said associated visual cue identification logo of one or more hearts and said associated removable tool is an award of behavior, a second said pocket having said associated visual cue identification logo of a lightning bolt and said associated removable tool is an electronic device, a third said pocket having said associated visual cue identification logo of a circle of three arrow heads forming a circle and said associated removable tool is student name sticks and a fourth said pocket having said associated visual cue identification logo of a sun and said associated removable tool is one or more colored writing implements, the second row includes a fifth said pocket positioned below the first said pocket of said first row in an overlap configuration, the fifth said pocket having said associated visual cue identification logo of a smiley face and said associated removable tool is a toy or treat and a sixth said pocket positioned below the fourth said pocket of said first row in an overlap configuration, the sixth said pocket having said associated visual cue identification logo of a thought balloon and said associated removable tool is a written article and post-it notes;

said pockets in the first and second rows forming a memory map via the associated visual cue identification logos matched to the predetermined arrangement of said pockets, and each of said pockets in said first and second rows are formed by vertical stitching of material to said apron;

wherein said each of said associated removable tools is used with instructional strategies.

* * * * *